United States Patent [19]

van der Vliet

[11] 4,085,021

[45] Apr. 18, 1978

[54] ELECTROPHORETIC PORCELAIN ENAMELING PROCESS

[75] Inventor: William Ewald van der Vliet, Capelle an der Ijssel, Netherlands

[73] Assignee: Ferro Corporation, Cleveland, Ohio

[21] Appl. No.: 763,020

[22] Filed: Jan. 27, 1977

[30] Foreign Application Priority Data

Feb. 2, 1976 Netherlands ..... 7601007

[51] Int. Cl.[2] ..... C25D 13/02; C25D 13/10

[52] U.S. Cl. ..... 204/181 N

[58] Field of Search ..... 204/181 N

[56] References Cited

U.S. PATENT DOCUMENTS 2,956,937 10/1960 Thomson ..... 204/181 N 3,475,316 10/1969 DeVittorio ..... 204/181 N

*Primary Examiner*—Howard S. Williams

*Attorney, Agent, or Firm*—Milton L. Simmons

[57] ABSTRACT

In the electrophoretic deposition of porcelain enamels, there is added to the bath one or more positive ions in an amount ranging from 10–95% of the positive ion concentration necessary to adjust the zeta potential, of the particles to be deposited electrophoretically, to zero.

5 Claims, No Drawings

ELECTROPHORETIC PORCELAIN ENAMELING PROCESS

The coating of steel articles with an enamel layer, by means of electrophoresis, is known. The enamel frit is generally put into a water suspension, for the purpose, by grinding the frit with water and possibly other additives. In the suspension, the separate frit particles are surrounded by a layer of strongly adsorbed ions which are immobile in relation to the particles and co-determine the charge of the whole. Around these are ions and polar molecules of opposite charge, which can move in relation to the said system.

Between the particle with the solid part of this double layer and the fluid, a potential difference, the zeta potential, prevails. The enamel frit particles with the solid adsorbed layer generally bear a negative charge, so that if a cathode and the article to be coated, as anode, are put into the fluid, and a potential difference applied between them, the particles move in the direction of the article to be coated and are deposited thereon.

The speed of the particles is determined by the equation:

$$\mu = \epsilon E \zeta / 4\pi\eta$$

in which $\epsilon$ = dielectric constant
$E$ = field strength
$\mu$ = speed of electrophoresis
$\zeta$ = zeta potential
$\eta$ = viscosity In this way high-quality coatings can be applied which also cover the inside of holes and edges with a corrosion-resistant enamel layer, which is important in apparatus which must generally be operated in wet surroundings (washing machines, cookers).

Naturally, it is of importance here that parts of the article, at different distances from the electrodes, can still be coated evenly with an enamel layer. Namely, differences occur in the electric field strength which, according to the above equation, lead to corresponding differences in the speed of electrophoresis of the particles. Especially in articles of complicated form, for example, with hollows and electrically shielded places along flanges, where as a result of the Faraday effect, a lower field strength prevails, it may be difficult to cover the whole article evenly with a coating layer, without auxiliary electrodes. However, it is important in practice to be able to use a coating bath with stationary electrodes for the coating of articles of different shape.

The said disadvantage can be eliminated by increasing the pH, as described in U.S. Pat. No. 3,841,986. In this case, however, iron is dissolved rapidly from the workpiece electrolytically, by which white enamel is given a cream coloring by the iron deposited therein. Various methods are known for combatting this coloration, for example, the application of a copper layer on the workpiece (U.S. Pat. No. 3,841,986), of a zinc layer (German Published Application No. 2,045,265) or by the subsequent removal of the iron by dipping in a strong acid (U.S. Pat. No. 3,841,986 and Dutch Patent Application No. 74.13,659).

In the electrophoretic application of a colored layer by adding, in the known way, inorganic colorants to the suspension of enamel frit particles, the colorant particles in the suspension have a different zeta potential, and consequently they have, during the electrophoresis process, according to the above-mentioned equation, a different migration speed.

This leads to the coating layer applied having a different percentage of colorant than the bath. During the coating of a large series of articles in the bath, therefore, the percentage of colorant in the bath will gradually change, and as a result, the color of the articles treated in it, also.

The invention is intended to reduce the two disadvantages mentioned above, and concerns a process for the electrophoretic application of a colored enamel layer on an article, in which, to the suspension of enamel frit particles and inorganic colorant particles, from which the coating is deposited, one or more kinds of positive ions are added in a concentration which amounts to 10–95% of the concentration which is necessary, with the same proportion of the different kinds of ions, to bring the zeta potential of the particles to be separated electrophoretically, back to zero.

These positive ions are generally added in the form of salts, which upon dissolving in the suspending medium, dissociate into positive and negative ions, for example, chlorides, sulfates, nitrates, nitrites, acetates, etc. These salts are so chosen that they bring the desired positive ions into solution and that the negative ions, present at the same time, exert no harmful influence on the process.

The suspension in question may also contain the usual additives, for example, clay, quartz, other minerals and slight amounts of organic material, for example, gum, resin, urea or cellulose derivatives.

Preferably the positive ions are added in a concentration which is 40–60% of the concentration which is necessary, with the same mutual proportion of the different kinds of ions, to bring the zeta potential back to zero.

The pH of the suspension is generally hardly affected in the process according to the invention. It has been found, surprisingly, that certain ions sensitize the influence of other ions. A synergistic effect occurs and it may therefore be advantageous to add, instead of one kind of positive ion, a combination of several kinds.

The articles enameled by the process of the invention show, besides the usual good surface quality, a noticeably better coating of the sides of the articles not turned toward the electrodes, then articles enameled in a bath without the additives distinctive of the invention. Moreover, by the process according to the invention, the difference in the speed of deposition between enamel frit and colorant particles is leveled, so that color constancy and bath stability are greatly improved, which is especially important when series of articles are to be enameled in succession in a bath containing inorganic pigments.

Without the additives characterizing the process of the invention, differences may occur between the percentage of colorant in the bath and in the layer deposited on the workpiece, up to 50% of the percentage present in the bath.

An added advantage of the process according to the invention is that the sediment from such a suspension is generally soft and can be brought into suspension again simply.

The invention is illustrated by the following example.

EXAMPLE

A semi-transparent boron-titanium white enamel is melted and fritted in the known way. The oxide composition is given in Table A.

TABLE A

| | |
|---|---|
| $B_2O_3$ | 18.51 % by wt. |
| ZnO | 4.14 % by wt. |
| $Na_2O$ | 9.82 % by wt. |
| $K_2O$ | 6.56 % by wt. |
| $Li_2O$ | 0.95 % by wt. |
| $TiO_2$ | 10.12 % by wt. |
| $P_2O_5$ | 2.66 % by wt. |
| $SiO_2$ | 44.20 % by wt. |
| MgO | 0.16 % by wt. |
| F | 4.99 % by wt. |

Then an aqueous suspension is prepared using the following mill addition.

| | |
|---|---|
| Frit (Table A) | 100.0 % by weight |
| Aerosil * | 1.0 % by weight |
| Bentonite | 0.1 % by weight |
| $CoO.Al_2O_3$ (Co-Al pigment) | 2.2 % by weight |

The suspension was brought to a specific weight of 1.50 gram per cc., after which 0.06% by weight carboxy methyl cellulose was added, based on the frit. Into this suspension was put a square plate of low-carbon steel, pretreated in the known way for electrophoretic white enameling, as anode, and a square stainless steel cathode, both 10 centimeters on a side, at a distance of 6.5 cm from each other. A voltage of 50 volts was applied for 15 seconds. The plate was then rinsed in water to remove the loosely-adhering paticles, dried and fired to 820° C. in an oven, in the known way, to a fused enamel layer. In analysis of the coating applied, before the firing process, it was found that the colorant content was 2.9%, that is, considerably higher than in the bath.

The uncoated surface, after the firing, on the side of the plate turned away from the cathode, is a measure of the power to coat with a uniform enamel layer even those parts of the workpiece which are far from the cathode or electrically shielded. According to the invention, 0.27% by weight $CaCl_2$, based on the amount of frit, was added to the bath. A second plate was coated in a corresponding way with an enamel layer.

The percentage of colorant in the layer was found by analysis to be approximately equal to that in the bath. The uncoated surface on the side of the plate away from the cathode is considerably less.

I claim:

1. In a process for the simultaneous electrophoretic deposition of at least two classes of particles normally having dissimilar zeta potentials respectively, and consequently different deposition velocities, the improvement of adjusting and stabilizing said velocities, respectively, of the said two classes of particles, by the addition to the electrophoretic bath of at least one positive ion, in a concentration ranging from 10 to 95% of the concentration necessary, vis-a-vis the total ionized particles present, to stabilize the zeta potential of the particles to be deposited electrophoretically, back to zero.

2. The process of claim 1, wherein the concentration of positive ions is 40 to 60% of the concentration necessary to stabilize the zeta potential at zero.

3. The process of claim 1, wherein at least two different positive ions are added.

4. The process of claim 2, wherein at least two different positive ions are added.

5. The process of claim 1, wherein two classes of particles are utilized, and they are porcelain enamel frit and pigment respectively.

* * * * *